US006094955A

United States Patent [19]

Vasko et al.

[11] Patent Number: 6,094,955

[45] Date of Patent: Aug. 1, 2000

[54] SELF-ORGANIZING ROLLING MILL

[75] Inventors: David A. Vasko, Macedonia; Francisco P. Maturana; Rebecca J. Herr, both of Twinsburg; Joseph A. Lenner, Hudson, all of Ohio; Stephen J. Vandenberg, Speers Point; Jeffrey Kian Chee Chang, Victoria, both of Australia

[73] Assignee: Rockwell Technologies, LLC, Thousand Oaks, Calif.

[21] Appl. No.: 09/290,453

[22] Filed: Apr. 12, 1999

[51] Int. Cl.[7] ..... B21B 37/16

[52] U.S. Cl. ..... 72/7.2; 72/8.1; 72/10.9; 72/14.6; 700/100; 700/150

[58] Field of Search ..... 72/7.1, 7.2, 8.1, 72/8.2, 10.1, 10.8, 10.9, 13.4, 14.6, 14.8, 14.9, 15.1, 16.1, 17.1, 17.2, 20.1, 20.2, 20.3, 21.1, 21.6; 700/100, 101, 106, 112, 115, 148, 149–150

[56] References Cited

U.S. PATENT DOCUMENTS 5,126,945 6/1992 Jenista et al. ..... 72/16.2
5,797,288 8/1998 Mas ..... 72/7.1
5,808,891 9/1998 Lee et al. ..... 364/468.15
5,953,279 9/1999 Clark et al. ..... 364/486.06

*Primary Examiner*—Ed Tolan
*Attorney, Agent, or Firm*—Keith M. Baxter; John J. Horn; William R. Walbrun

[57] ABSTRACT

A rolling mill system associates an autonomous control unit with each piece of equipment in the rolling mill system. The autonomous control unit has a model of the particular piece of equipment, for example, of the rolling mill, a reheat furnace or a cooling bath, and data indicating constraints on the operation of the equipment. A metal shape to be produced is described as a set of machine independent steps, and the performance of these steps is bid upon by the autonomous control units according to the constraint models and internal goals. Bids having conflicting requirements may generate counterbids until a complete plan for the production of the product is generated.

17 Claims, 6 Drawing Sheets

SELF-ORGANIZING ROLLING MILL

CROSS-REFERENCE TO RELATED APPLICATIONS

STATEMENT REGARDING FEDERALLY SPONSORED RESEARCH OR DEVELOPMENT

BACKGROUND OF THE INVENTION

The present invention relates to rolling mills for producing metal shapes and in particular to a rolling mill using an industrial controller that automatically organizes the components of the rolling mill for the manufacture of a product based on the capabilities of the rolling mill components.

Rolling mills employ a set of movable rollers to shape metal billets into a variety of "shapes" such as angle, channel or rod of various diameters. A rolling mill is typically used as part of a rolling mill system, including for example, an upstream reheat furnace or continuous casting machine providing heated billets, and a downstream water bath or Stelmor conveyor cooling the rolled material.

A given rolling mill system is capable of producing a wide variety of shapes by a changing in the operational parameters of the system, including the roller dies, die separation, rolling speeds and temperatures. In a rolling mill system including multiple rolling mills, furnaces and cooling baths, the path through the machines may also be varied.

Reconfiguring a roller mill system is currently time consuming and expensive, and involves not only setting the operating parameters for each of the component pieces of equipment, but ensuring that there is consistency between those operating parameters. For example, the speed through the water bath normally must match the desired rolling speed through the rolling mill. This step of ensuring a matching of operating parameters between the component machines of the rolling mill system complicates the selection of optimal operating parameters and makes determining the trade-offs between the settings for different machines harder. This arises from the fact that although each machine may be modeled in a forward direction, that is, it may be determined how a change in rolling speed or die separation affects the billet temperature, the machines are not easily modeled in the reverse direction where there is no functional mapping. Thus, if a downstream water bath requires a different billet speed from a rolling mill, adjustment of the rolling mill presents a complex variety of alternatives.

For this reason, it is normally desired to minimize the changes in rolling mill setup, a desire that is at odds with economic demands to change the rolling mill setup frequently and quickly to respond to changing product demand. It would be beneficial to have a rolling mill system that could automatically and quickly organize itself to produce the desired product. It would further be desirable that this system accommodate a large variety of different types of rolling mill equipment.

BRIEF SUMMARY OF THE INVENTION

The present invention provides a rolling mill system where each piece of equipment is associated with an autonomous control unit and where the different pieces of equipment receive a job plan and then negotiate among themselves to satisfy this job plan.

The vehicle for the negotiation is a set of bids and counterbids electronically communicated between the equipment. When counterbids affect the output of a particular piece of equipment, an iterative reverse modeling system is used to drive possible changes in the equipment's input parameters.

Specifically, the present invention provides a rolling mill system, including a rolling mill having an entrance receiving billets at an input temperature, a set of rolls rolling a received billet to change the billet by a rolling diameter as moved at a rolling speed, and an exit discharging the rolled billet at an output temperature. The rolling mill is also associated with an autonomous control unit having an electronic memory holding data which includes rolling mill constraints indicating constraints on the operation of the rolling mill, and inter-machine relationships indicating physical operating parameters of the rolling mill dependent on operating parameters of other machines to which the rolling mill is connected. The rolling mill constraints may include input temperature, rolling diameter and rolling speed, and the other machines may include reheat furnaces, water baths and Stelmor conveyors.

An electronic computer communicating with the electronic memory executes a stored program to receive a job description describing the manufacture of a product requiring rolling mill operations. In response to the job description and bids by autonomous control units of the other machines, bids are transmitted to the autonomous control units of the other machines proposing performance of a task by the rolling mill within the rolling mill constraints and the inter-machine constraints. In response to counter-bids received from other autonomous control units, the autonomous control unit of the rolling mill transmits a modified bid describing performance of a task by the rolling mill within the rolling mill constraints and the inter-machine constraints, and satisfying the counter bid.

Thus, it is one object of the invention to permit a rolling mill to automatically organize itself for the production of metal shapes. By investing control units of the components of the rolling mill system with goals and knowledge of the capabilities of the equipment, the rolling mill system may evaluate alternatives for the production of the shape.

It is another object of the invention to make use of the market model of bids and counterbids for resolving conflicting demands between equipment in producing a shape where multiple options are available. Importantly, the present invention provides predictable control of a rolling mill and a solution that is assured to be possible to be implemented by the rolling mill machines.

Each of the other elements of the rolling mill system may also include a similar autonomous control unit having knowledge of its constraints and of the inter-machine relationships and responsive to bids and counterbids as described above.

Thus, it is another object of the invention to provide a general purpose control unit structure that may be independently adapted to any machine so as to allow an arbitrary mixing and matching of machines to create a rolling mill system that may still partake of the automatic configuration offered by the invention.

The foregoing and other objects and advantages of the invention will appear from the following description. In the description, reference is made to the accompanying drawings which form a part hereof and in which there is shown by way of illustration a preferred embodiment of the invention. Such embodiment does not necessary represent the full scope of the invention, however, and reference must be made to the claims herein for interpreting the scope of the invention.

DETAILED DESCRIPTION OF THE INVENTION

Components of the Control System

Figure 1:
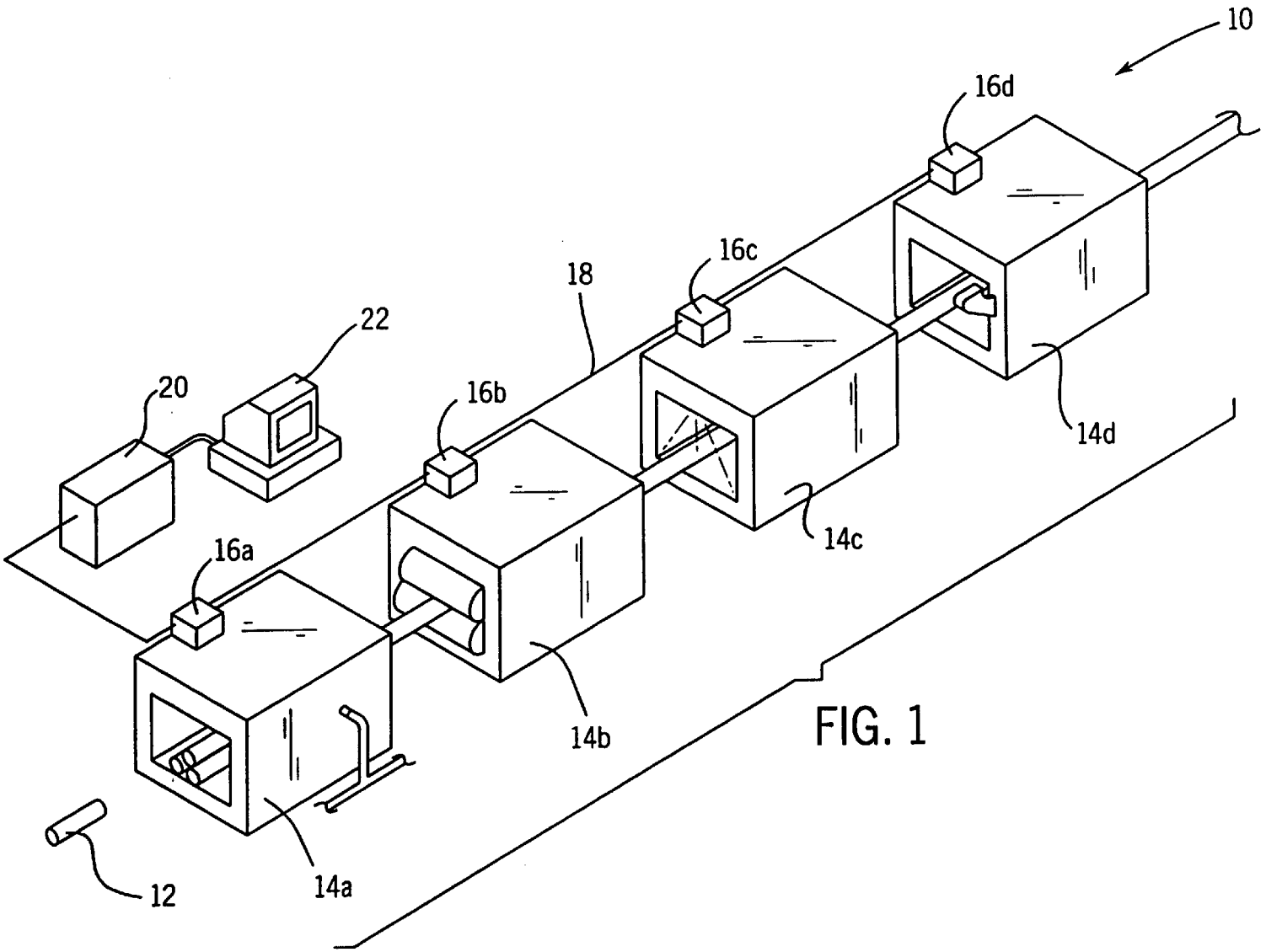
FIG. 1 is a perspective view of a simplified rolling mill composed of a sequential set of machines each associated with an autonomous control unit per the present invention.

Referring now to FIG. 1, an industrial process 10 may provide for the processing of metal billets 12 through a series of machines 14. Each machine 14 may have an associated autonomous control unit 16 being either discrete devices as shown in FIG. 1 or portions of a centralized machine. The autonomous control units 16 are interconnected by a common communication link 18 and are also connected by the communication link 18 to a computer 20 and a human/machine interface such as a computer terminal 22 of conventional design.

In an example process 10 suitable for control by the present invention, machine 14 may include a reheat furnace 14*a* for heating the billets 12 to a predetermined temperature, a rolling mill 14*b* for rolling the billets 12 to a predetermined diameter, a water bath 14*c* for cooling the billets 12 with water and a Stelmor conveyor 12*d* cooling the billets 12 with air.

Figure 2:
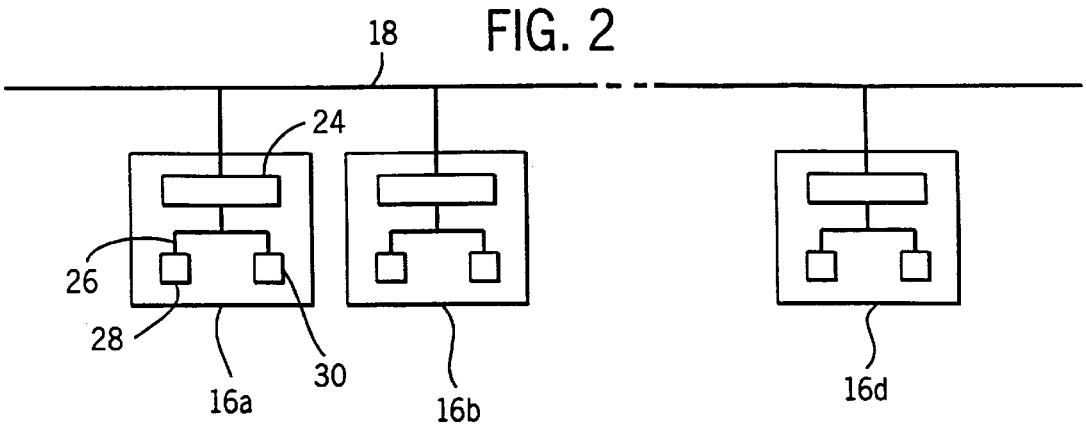
FIG. 2 is a schematic block diagram of the autonomous control units of FIG. 1 showing the interconnection of the autonomous control units through interfaces on a common link and a processor and memories of the autonomous control units.
Figure 3:
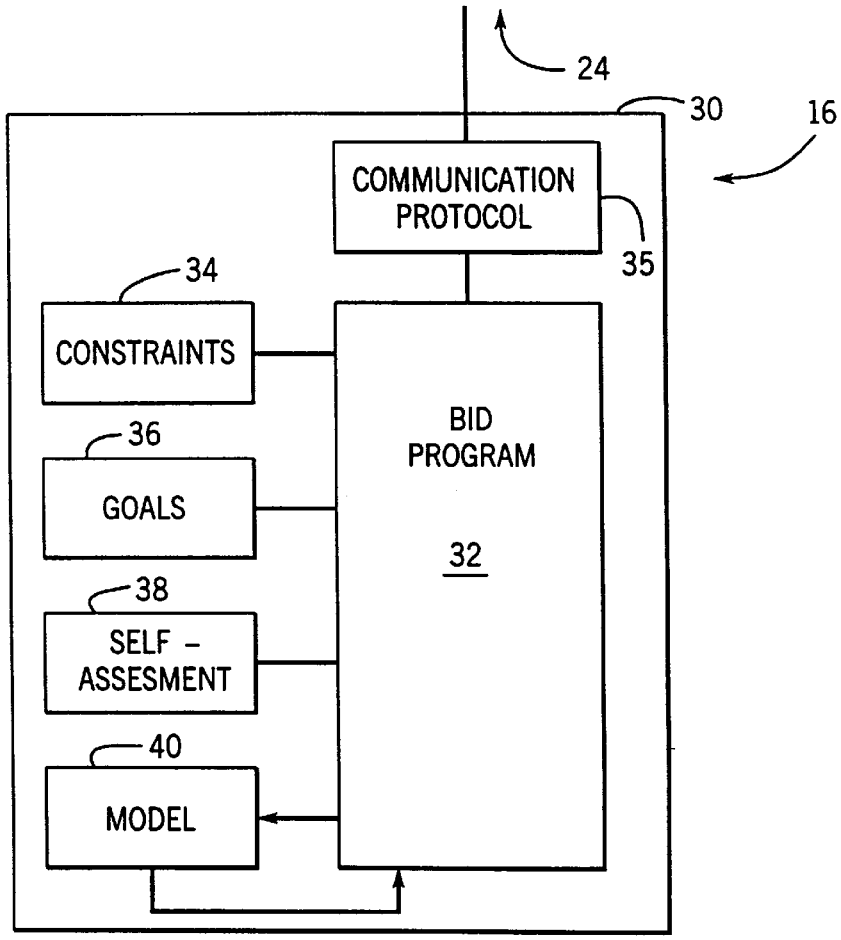
FIG. 3 is a detailed block diagram of the memory of one autonomous control unit of FIG. 2 showing the contained bid program, constraint data, goal data, self-assessment data, and a model of the equipment associated with the autonomous control unit.

Referring now to FIGS. 2 and 3, each autonomous control unit 16 includes an interface circuit 24 connected with the common communication link 18 and handling communication protocols so that the autonomous control units 16 may communicate bids and counterbids among themselves and may receive a job description as will be discussed below. The interface circuits 24 of each autonomous control unit 16 are connected by an internal bus 26 to a processor 28 and memory 30.

Data Structures

Referring now to FIG. 3, the memory 30 holds a bid program 32 that will be used to generate bids and counterbids to be exchanged among the autonomous control units 16 in developing a control strategy for the machines 14. The bid program 32 communicates with the other autonomous control units 16 according to a communications protocol program 35 which also serves to store and sort bids and counterbids and job descriptions and direct bids and counterbids to the correct device as will be described.

The bid program 32 has access to stored data tables representing constraint data 34 which generally quantifies the limitations of performance of the associated machine 14, goal data 36, which describes preferences among modes of operation of the associated machine 14 within the constraints 34, self-assessment data 38 generally describing the dynamic state of the associated machine, and a model 40 modeling operation of the associated machine by mathematical means.

Figure 4:
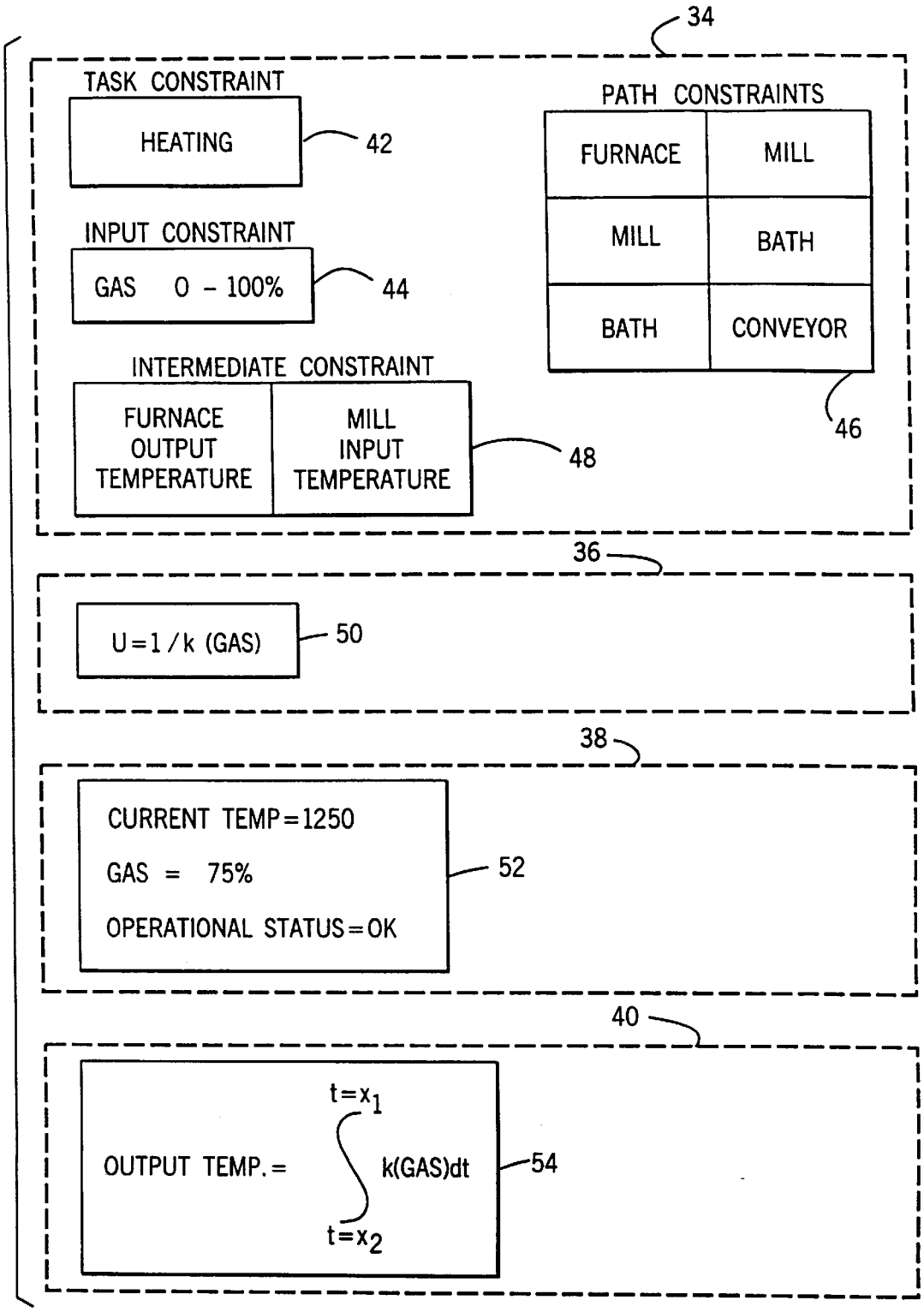
FIG. 4 is an expanded block diagram of the constraint data, goal data, self-assessment data, and model of FIG. 3.

Referring to FIG. 4, the constraints 34 are of a number of different kinds. Task constraints 42 describe generally the kind of operation that the associated machine 14 is intended to perform. Thus, for example, the reheat furnace 14*a* may perform heating tasks. The task constraints 42 allow the autonomous control units 16 to make a threshold determination as to whether their associated machines 14 will make a bid for a particular task of a plan to produce a product. Continuing with the example of the reheat furnace 14*a*, the autonomous control unit 16*a* of the reheat furnace 14*a* will only bid for tasks requiring heating.

In contrast, the constraint data also includes input constraints 44 describing the limits of the inputs to the associated machine 14. The inputs (as opposed to the outputs of the machines 14) are well defined and their ranges are set by the physical design of the machine. For example for the reheat furnace 14*a*, the input will be the amount of the gas valve opening and the range of the input will be from zero to one hundred percent. For the rolling mill 14*b*, the inputs will be rolling diameter and rolling speed. For the water bath 14*c*, the input will be water flow rate and rolling speed and for the Stelmor conveyor 14*d*, the inputs will be rolling speed and air flow rate.

The constraints 34 also include path constraints 46 which generally reflect limitations on the possible paths of the product, the billet 12, between machines 14 as dictated by their physical layout. In this example, a single simplified path is available in which the billet 12 passes from reheat furnace 14*a* to rolling mill 14*b*, then to water bath 14*c* and finally to Stelmor conveyor 14*d*. This path topology is reflected in the path constraints 46 listing each machine 14 in a first column and all successor machines 14 in a second column. From this table, all possible paths between machines 14 may be determined. Often there will be multiple paths of product flow and thus multiple points of communications between machines 14 and in this case the second column may have more than one machine listed. The path constraints 46 and the input constraints 44 will be termed generally "operational" constraints as they constrain the operation of the machine 14.

Deriving from the path constraints 46 and possibly including some of the input constraints are the "inter-machine" or "intermediate" constraints 48 representing parameters shared between machines 14 based on the path of the material between machines 14. Thus the input temperature of the rolling mill 14*b* will be constrained to be equal to output temperature of the reheat furnace 14*a* based on their layout. Further, the rolling mill 14*b* and water box 14*c* also share output and input temperatures, respectively, and also billet speed i.e., the speed of exit of the billet 12 from the rolling mill 14*b* equaling the speed of entry of the billet into the water box 14*c*.

As a result of the coiling of the billet product in the Stelmor conveyor 14*d*, the water box 14*c* and Stelmor conveyor 14*d* do not share the parameter of conveyor speed but do share the parameter of temperature as the temperature of the billet output from the water box 14*b* will equal the temperature of the billet 12 entering to the Stelmor conveyor.

Referring still to FIGS. 3 and 4, the goal data 36 is implemented as a utility function 50 having as input arguments one or more of the characterizing parameters of the machine 14 either inputs or outputs, and as a value, an arbitrarily defined utility which reflects a preprogrammed goal of the autonomous control unit 16. In the case of the reheat furnace 14*a*, the utility function 50 may be inversely proportional to the gas valve opening indicating a goal to reduce gas consumption. A more complex utility function 50 might consider the stability of the furnace temperature reflecting the fact that it is advantageous to keep the temperature at a steady state in anticipation of other products. Generally the autonomous control unit 16 strives to maximize utility within the operational and intermediate constraints.

Other machines will have other goals as selected and programmed by the user or manufacturer. For example, the rolling mill 14*b* may have a goal of high speed which relates to higher productivity. The goals for the water box 14*c* and Stelmor conveyor 14*d* are generally reduction of water and air volume, respectively.

Referring still to FIGS. 3 and 4, the self-assessment data 38 will typically include various sensed parameters 52 of the associated machine 14. As shown in FIG. 4 for the reheat furnace 14*a*, the self-assessment data includes current furnace temperature (a sensed output) and the input of a gas valve opening. A general operational status for the reheat furnace 14*a* may also be provided as generated from other inputs and outputs and possibly a heuristic program evaluating the fitness of the machine 14. Generally, the self-assessment data 38 is used to modify the operation constraints 34 if the operational status of the machine 14 is somehow impaired.

The model 40 provides a mathematical description 54 relating inputs to the machine 14 to its outputs. In the example of the reheat furnace 14*a*, a simple integral relationship is shown relating output temperature of the furnace 14*a* to the integral over time of the amount of gas valve opening. This model reflects generally the fact that the temperature is proportional to the opening of the gas valve over a previous interval. Generally far more complex models may be created relating one or more inputs to particular outputs of the machine.

For the rolling mill 14*b*, the model 40 will take into account the effective rolling speed and diameter reduction of the billet 12 on the billet's temperature. The model for the water box 14*c* may relate cooling water flow and process speed to surface and internal temperatures. The model 40 for Stelmor conveyor 14*d* will provide a time and air flow relationship to temperature of the output billet 12. The construction of such models is generally understood in the art and will depend on the particular machine 14.

Job Description Language

Figure 5:
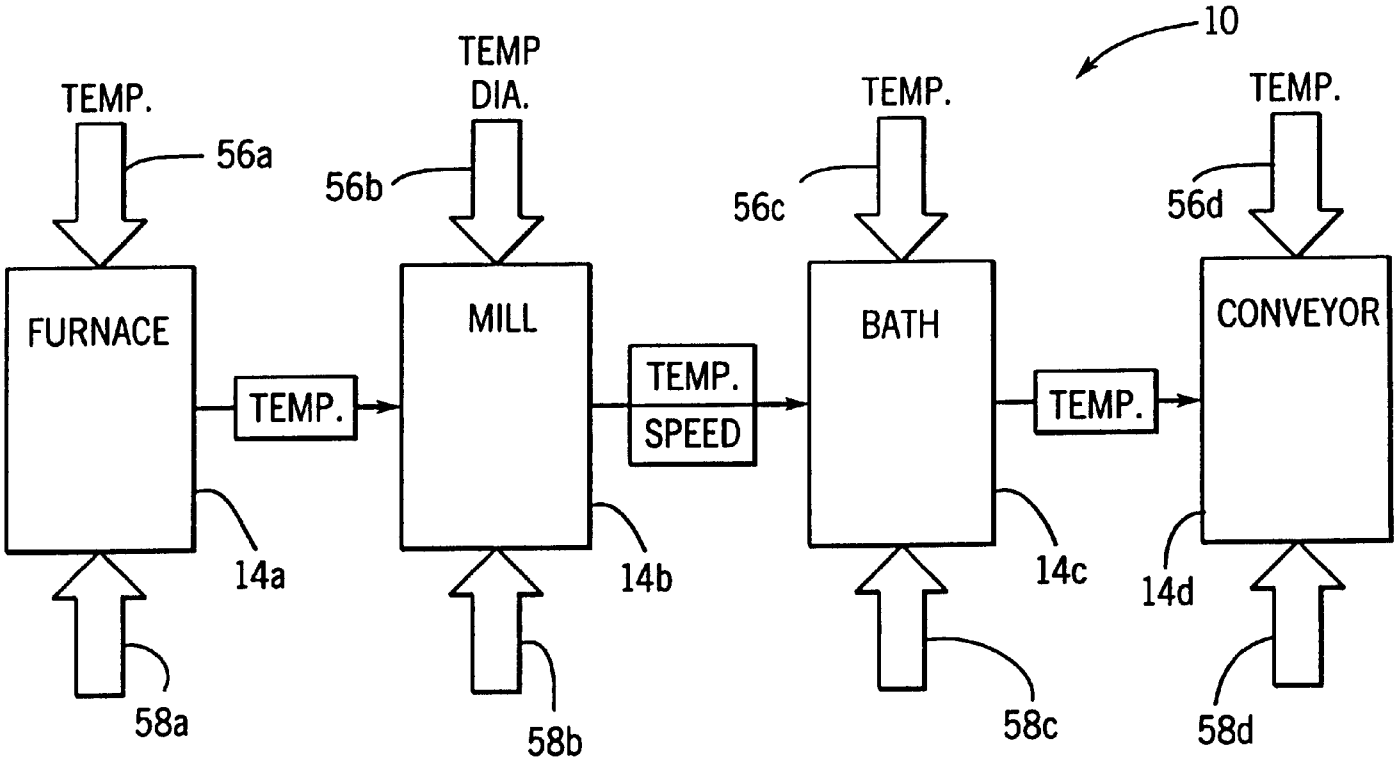
FIG. 5 is a graphical representation of the equipment of the rolling mill of FIG. 1 as defined by various inputs and constraints.

Referring now to FIGS. 1 and 5, a "product" autonomous control unit 16 may be implemented by the computer 20 to represent the desired product to be manufactured from the billet 12. This product autonomous control unit provides a convenient unit for implementing the functions of describing the product to the autonomous control units 16 of the machines 14 and of evaluating the plans produced by the autonomous control units 16 against the product definition. For this first task, the product autonomous control unit, accepts input from a user through computer terminal 22 describing the product characteristics and produces a machine independent description of desired tasks for producing that product in a job description language. In the preferred embodiment, the job description language is an ASCII text file providing a number of steps defining desired machine outputs. For example, to produce a rolled billet, the job description is as follows:

```
STEP 1=   GOTO TEMP(ALL)<1300.0
STEP 2=   GOTO DIAMETER=5.5 TOL(-0.2, 0.2)
          CONSTRAIN TEMP(ALL)<1300.0
          CONSTRAIN TEMP(ALL)>825.0 AT TIME=END
          DEPENDS ON (1)
STEP 3=   GOTO TEMP(SURF)=850 TOL(-5.0, 5.0)
          CONSTRAIN TEMP(ALL)>825.0 AT TIME=0.0
          CONSTRAIN TEMP(SURF)>450.0 AND<1300.0
          WITH DIAMETER=5.5
          DEPENDS ON (2)
STEP 4=   GOTO TEMP(AVG)=650.0 TOL(-5.0, 5.0) IN
          TIME<15.0
          CONSTRAIN TEMP(SURF)>500 AT TIME>0.0
          AND
<=2.0
          WITH DIAMETER=5.5
          DEPENDS ON (3)
STEP 5=   GOTO TEMP(AVG)=600.0 TOL(-5.0, 5.0) IN
          TIME >40.0
          WITH DIAMETER = 5.5
          DEPENDS ON (4)
```

Each step defines temperatures (TEMP), diameters (DIAMETER) and tolerances (TOL) of the billet and the sequence (DEPENDS ON) and timing (AT TIME) of the steps. In this example both surface temperature (SURF) and overall temperature (ALL) is considered and so the models 40 must provide outputs for both.

Operation of the Control System

Figure 6:
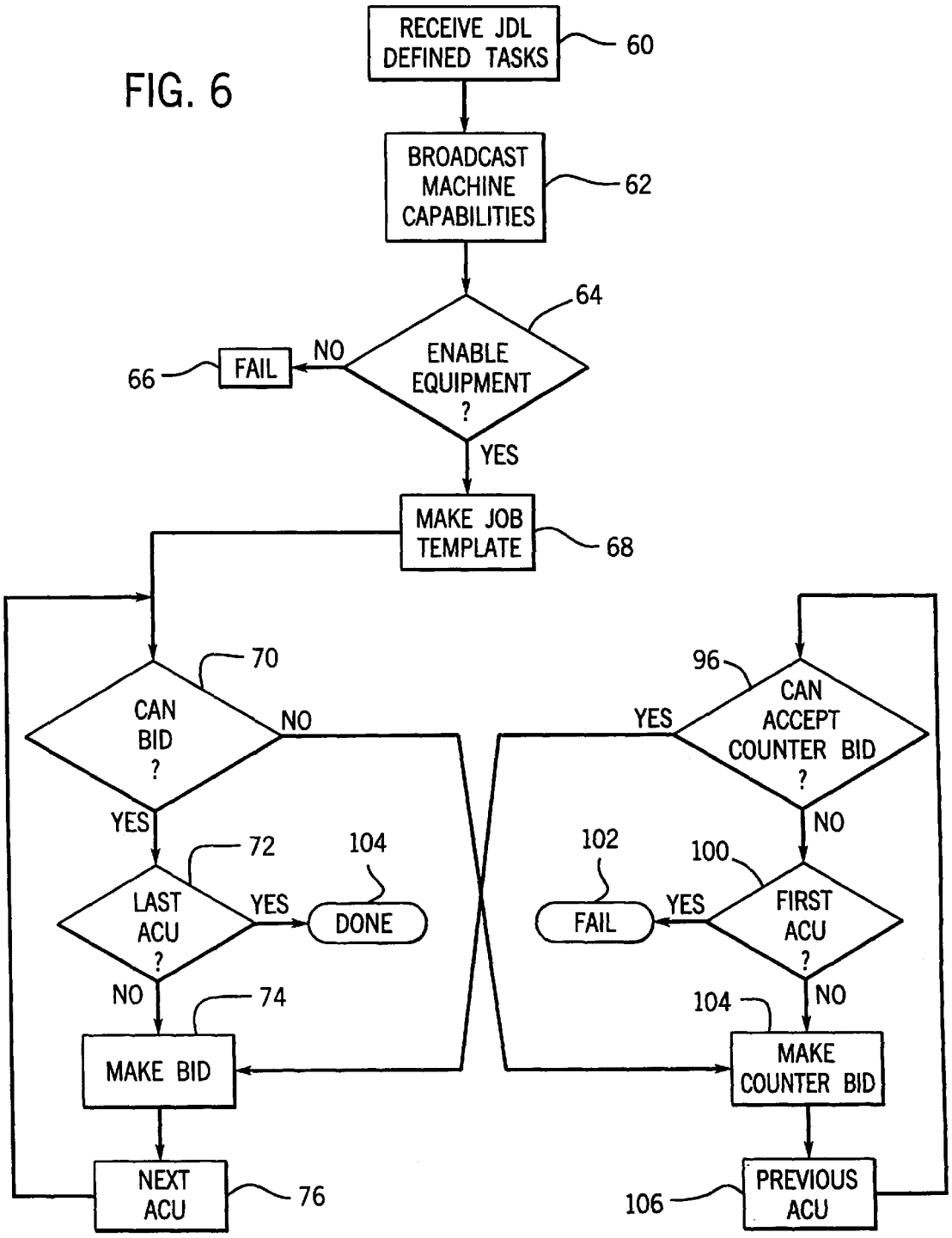
FIG. 6 is a flow chart of the bid program of FIG. 3 such as may be used to generate a control strategy for the machines of FIGS. 1 and 5.

The operation of the autonomous control units 16 (and the computer 20) will now be described with reference to the flow chart of FIG. 6. The flow chart of FIG. 6 is executed in part by different autonomous control unit 16*a* and the computer 20 as will be apparent from context.

At a first step, the job description language (JDL) is generated by the autonomous control unit implemented in computer 20 for the product is represented by process block 60. At succeeding process block 62, the JDL is broadcast over the communication link 18.

As indicated by decision block 64, each autonomous control unit receiving the broadcast JDL evaluates the tasks of the JDL generally in light of its own task constraints 42 and submits to the most upstream autonomous control unit 16 in the path (indicated by the path constraints 46), and in this case the reheat furnace 14*a*, an indication of which tasks represented by steps in the JDL, it can perform.

The most upstream autonomous control unit 16*a*, based on the received indications about task capability from the other autonomous control units 16, next tries to create one or more "template plans" representing a possible allocation of tasks to machines 14. In the event that there is not at least one autonomous control unit 16 indicating an ability to perform at least each step, the JDL, the most upstream autonomous control units 16*a* proceeds to a fail state 66 indicating that the desired product cannot be produced by the machines 14.

More typically, at process block 68, one or more job templates will be created as described. A number of different job templates may address different allocation of machines 14 to different steps of the JDL or different material flow paths in the case where the topology is not as simple as the example used herein or different job templates may address different products.

The most upstream machine 14, in this case the reheat furnace 14*a*, then reads the first step of the JDL, which in this case that indicates the temperature of the product should be raised to a value of less than 1300 degrees, and evaluates whether it can create a bid for that task as indicated by process block 70. Specifically, the autonomous control unit 16 evaluates its current temperature in its self-assessment 52 and its goals 36 and the requirements of the JDL create a bid indicating a specific temperature to which the reheat furnace will raise the billet 12. In this case there are as yet no intermediate constraints 48.

Assuming that the autonomous control unit 16*a* of the reheat furnace 14*a* may make a bid within the above constraints, the program proceeds to decision block 72 to test if this is the last autonomous control unit on the job path (i.e., the Stelmor conveyor 14*d*). At this time it is not, and so the program proceeds to process block 74 where a bid is perfected by broadcasting it to the succeeding rolling mill 14*b* and more generally to the autonomous control unit(s) immediately downstream from the autonomous control unit 16 making the bid. The autonomous control unit 16*a* also updates an internal bid storage table (not shown).

The process then proceeds to the next autonomous control unit 16*b* as generally shown by process block 76. The next autonomous control unit 16*b*, associated with the rolling mill 14*b*, receives the template plan and the bid proposed by the reheat furnace 14*a*. At process block 70, autonomous control unit 16*b* determines whether it can make a bid based on the information from the JDL and on the constraints 34, including this time, from the intermediate constraint table 48 which links the input temperature or the rolling mill 14*b* to the output temperature of the reheat furnace 14*b*. In the example given, the JDL requires that the temperature of the billet 12 be greater than 825 degrees at the end of the rolling. Assuming for the moment that the temperature selected by the reheat furnace 14*a* is insufficient for the rolling mill 14*b* to reach the required output temperature (as may be determined by model 40 for the rolling mill 14*b*), then at process block 70, the autonomous control unit 16*b* proceeds to process block 104 to generate a counterbid because no bid could be generated meeting the then existent constraints.

For the counterbid, the autonomous control unit 16*b* must first determine an acceptable input temperature to the rolling mill 14*b*. Generally this cannot be done by consulting stored input constraints for temperature because the relevant constraints will dynamically depend on the particular output temperature required. Accordingly the program 32 of the autonomous control unit 16*b* must refer to the model 40.

Figure 7:
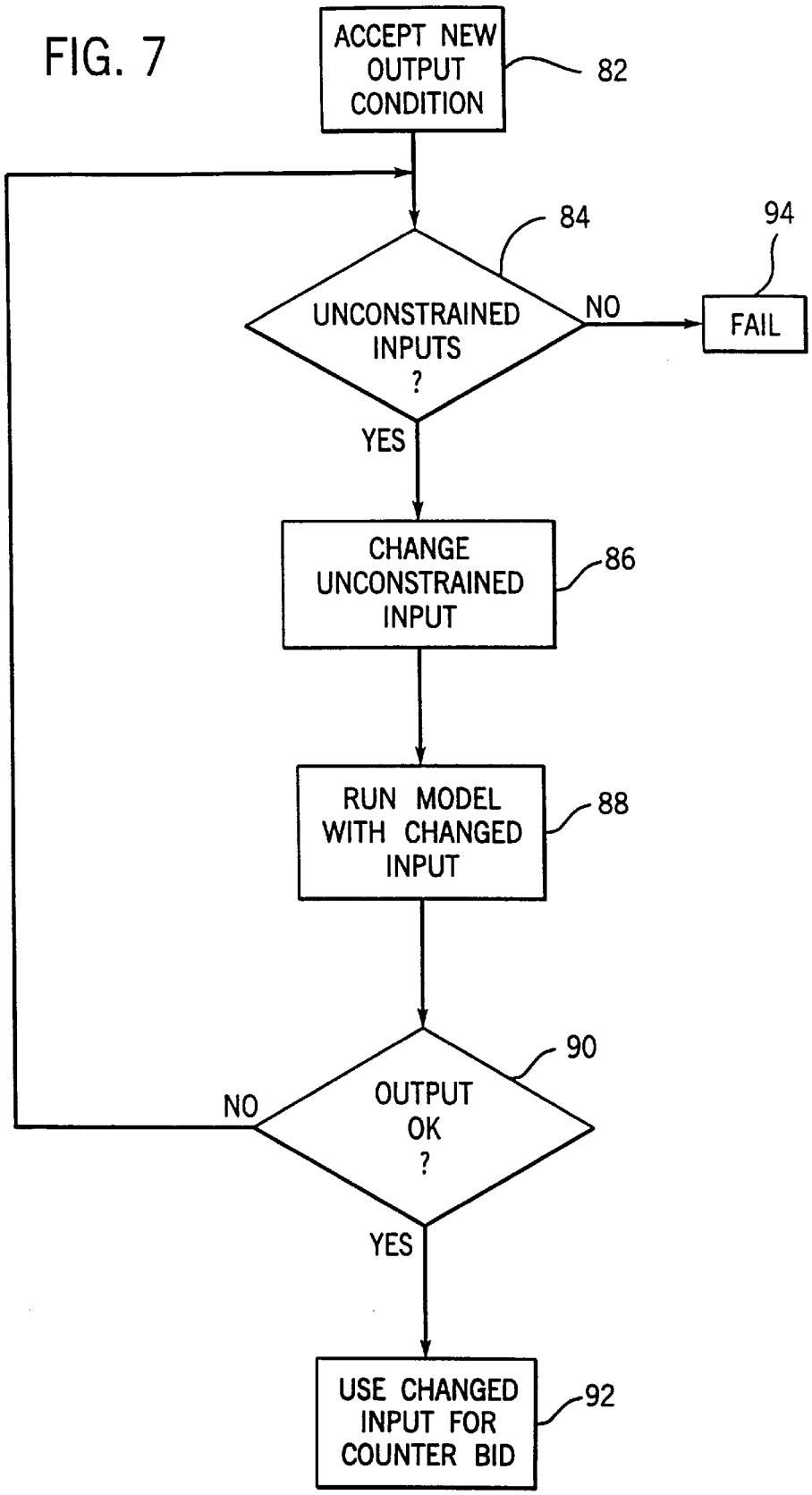
FIG. 7 is a flow chart of the operation of the model of FIGS. 3 and 4 in responding to a counterbid per the flow chart of FIG. 6.

Referring now to FIG. 7, the process of determining the necessary input temperature (or an arbitrary input model from a defined output) begins at process block 82 in which the new defined output condition is established. In this example, the output condition is a temperature of greater than 825 degrees as required by the JDL.

At decision block 84, an unconstrained input is identified, in this case an input temperature from the reheat furnace 14*a* within the temperature range permitted by the rolling mill 14*b*. By unconstrained it is meant that the input may be varied in a desired direction without violating the input constraints 44.

At process block 86, the identified input is modified in a direction to reduce the difference between the desired output value (per the JDL and process block 82) and the modeled output value produced by evaluating the model 40 with the unmodified input. The modified input is then evaluated by executing the model 40 as indicated at process block 88 to produce a new output.

At decision block 90, the current output from the model 40 is matched to the desired new output from process block 82 and if the outputs match within a tolerance the modified, input established at process block 86 is used for the counterbid as indicated by process block 92.

More typically, at least initially, the outputs will not match and the program loops back to process block 84 for a second or subsequent iteration. If prior to a matching of the outputs, the input becomes constrained and there are no further inputs that can be modified, the program proceeds to a fail block 94 indicating the process cannot be completed.

Referring again to FIG. 6, assuming that a suitable counterbid can be obtained at process block 92 of FIG. 7, the counterbid is perfected by forwarding it to the preceding autonomous control unit 16 in this case autonomous control unit 16*a*.

Autonomous control unit 16*a* receiving the counterbid at decision 96, determines whether it can accept the counterbid's new proposed output temperature by making a modified bid. Again the model 40 for the reheat furnace 14*a* may be invoked to determine whether with practical inputs (per input constraints 44), the desired output temperature value can be obtained. If the counterbid may be accepted, the autonomous control unit 16*a* creates a bid as indicated by process block 74 which is sent to the next succeeding autonomous control unit 16*b* as part of the job template as before and received by autonomous control unit 16*b* at process block 70 as has been described.

Referring again to decision block 96, if the counterbid cannot be accepted, then at decision block 100 a test is performed to see it the autonomous control units 16 receiving the counterbid is the first autonomous control unit 16. If it is, then the program proceeds to process block 102 and a failure condition is indicated as would be the case were the reheat furnace 14*a* receiving the counterbid.

More typically, however, the autonomous control unit 16 receiving a counterbid will not be the first autonomous control unit 16 and thus it is possible to make yet another counterbid indicated by process block 104 to yet an earlier autonomous control unit 16 so as to possibly relax an earlier intermediate constraint.

Bids and counterbids may thus ripple up and down the chain of autonomous control units 16*a*, 16*b*, 16*c*, and 16*d* until at process block 72, the last autonomous control unit in the material path successfully bids and the program proceeds to process block 104 and the completed plan is forwarded to the product autonomous control unit in the computer 20 to be evaluated along with other plans.

The product autonomous control unit in computer 20 may then accept one of the plans or may change the job description in a process analogous to the counterbidding proposal and the process may be repeated. As a result of the possibility of unresolvable bidding outcomes, the product autonomous control unit 16 normally produces a time limit on the process which if exceeded causes the process to indicate a failure.

The above description has been that of a preferred embodiment of the present invention, it will occur to those that practice the art that many modifications may be made without departing from the spirit and scope of the invention. In order to apprise the public of the various embodiments that may fall within the scope of the invention, the following claims are made.

We claim:

1. An automatically configurable rolling mill system comprising:

a rolling mill having an entrance receiving billets at an input temperature, a set of rolls rolling a received billet to change the billets by a rolling diameter as moved at a rolling speed, and an exit discharging the rolled billet at an output temperature;

a rolling mill autonomous control unit having:

(a) an electronic memory holding data representing:

(i) rolling mill constraints indicating constraints on the operation of the rolling mill;

(ii) inter-machine constraints indicating physical operating parameters of the rolling mill dependent on operating parameters of other machines to which the rolling mill is connected;

(b) an electronic computer executing a stored program to:

(i) receive a job description describing a manufacture of a product requiring rolling mill operations;

(ii) in response to the job description and bids by autonomous control units of other machines, transmitting a bid to the autonomous control units of the other machines describing performance of a task by the rolling mill within the rolling mill constraints and the inter-machine constraints;

(iii) in response to counterbids received from other autonomous control units, transmitting a modified bid describing performance of a task by the rolling mill within the rolling mill constraints and the inter-machine constraints and satisfying the counterbid;

whereby the rolling mill automatically determines its operating parameters for the manufacture of the product.

2. The automatically configurable rolling mill system of claim 1 wherein the other machines are selected from the group consisting of reheat furnaces, water baths and Stelmor conveyors.

3. The automatically configurable rolling mill system of claim 1 wherein the rolling mill constraints are selected from the group consisting of input temperature, rolling diameter and rolling speed.

4. The automatically configurable rolling mill system of claim 1 wherein the rolling mill constraints include a task constraint of diameter reduction and wherein the rolling mill autonomous control unit transmits a bid and in the alternative, a counterbid only if the task of diameter reduction is on the list of tasks of the job description.

5. The automatically configurable rolling mill system of claim 1 wherein the inter-machine constraints are parameters of shared inputs and outputs between the rolling mill and the other machines.

6. The automatically configurable rolling mill system of claim 4 wherein the inter-machine relationships are selected from the group consisting of input temperature, output temperature and rolling speed.

7. The automatically configurable rolling mill system of claim 1:

wherein the electronic memory holds multiple rolling mill constraints and inter-machine relationships identified to different material paths between the rolling mill and the other machines; and wherein the rolling mill constraints associated with a given material path are only modified by counterbids of the other machines associated with the given material path.

8. The automatically configurable rolling mill system of claim 1 further including:

a reheat furnace having an entrance receiving billets at an input temperature, a heater heating the billets to a reheat temperature and an exit discharging the billets at the reheat temperature;

a reheat furnace autonomous control unit having;

(a) an electronic memory holding data representing;

(i) reheat furnace constraints indicating constraints on the operation of the reheat furnace;

(ii) inter-machine constraints indicating physical operating parameters of the reheat furnace dependent on operating parameters of other machines to which the reheat furnace is connected;

(b) an electronic computer executing a stored program to:

(i) receive a job description describing a manufacture of a product requiring reheat operations;

(ii) in response to the job description and bids by autonomous control units of the other machines, transmitting a bid to the autonomous control units of the other machines describing performance of a task by the reheat furnace within the reheat furnace constraints and the inter-machine constraints;

(iii) in response to counterbids received from other reheat furnace autonomous control units, transmitting a modified bid describing performance of a task by the reheat furnace within the reheat furnace constraints and the inter-machine constraints and satisfying the counterbid;

whereby the reheat furnace automatically determines its operating parameters for the manufacture of the product.

9. The automatically configurable rolling mill system of claim 1 wherein the reheat furnace constraints are selected from the group consisting of input temperature and reheat temperature.

10. The automatically configurable rolling mill system of claim 1 wherein the reheat furnace constraints include a task constraint of heating and wherein the reheat furnace autonomous control unit transmits a bid and, in the alternative, a counterbid only if the task of heating is on the list of tasks of the job description.

11. The automatically configurable rolling mill system of claim 1 wherein the inter-machine constraints are parameters of shared inputs and outputs between the reheat furnace and the other machines.

12. The automatically configurable rolling mill system of claim 4 wherein the inter-machine relationships include input temperature and reheat temperature.

13. The automatically configurable rolling mill system of claim 1 further including:

a water bath having an entrance receiving billets at an input temperature, a water spray cooling the billets to a cooled temperature and an exit discharging the billets at the cooled temperature;

a water bath autonomous control unit having:

(a) an electronic memory holding data representing;

(i) water bath constraints indicating constraints on the operation of the water bath;

(ii) inter-machine constraints indicating physical operating parameters of the water bath dependent on operating parameters of other machines to which the water bath is connected;

(b) an electronic computer executing a stored program to;

(i) receive a job description describing a manufacture of a product requiring cooling;

(ii) in response to the job description and bids by autonomous control units of the other machines, transmitting a bid to the autonomous control units of the other machines describing performance of a task by the water bath within the water bath constraints and the inter-machine constraints;

(iii) in response to counterbids received from other autonomous control units, transmitting a modified bid describing performance of a task by the water bath within the water bath constraints and the inter-machine constraints and satisfying the counterbid;

whereby the water bath automatically determines its operating parameters for the manufacture of the product.

14. The automatically configurable rolling mill system of claim 13 wherein the water bath constraints are selected from the group consisting of input temperature, water flow rate and rolling speed.

15. The automatically configurable rolling mill system of claim 13 wherein the water bath constraints include a task constraint of cooling and wherein the water bath autonomous control unit transmits a bid and, in the alternative, a counterbid only if the task of cooling is in the job description.

16. The automatically configurable rolling mill system of claim 13 wherein the inter-machine constraints are parameters of shared inputs and outputs between the reheat furnace and the other machines.

17. The automatically configurable roiling mill system of claim 4 wherein the inter-machine relationships include input temperature, cooling temperature and rolling speed.

* * * * *